United States Patent [19]

Launer

[11] Patent Number: 5,004,072

[45] Date of Patent: Apr. 2, 1991

[54] WORK PLATFORM APPARATUS FOR ROOFS

[76] Inventor: Russell C. Launer, 9051 W. Temple Pl., Littleton, Colo. 80123

[21] Appl. No.: 467,440

[22] Filed: Jan. 19, 1990

[51] Int. Cl.[5] ..... E04G 5/08; E04G 3/12

[52] U.S. Cl. ..... 182/45; 248/237

[58] Field of Search ..... 182/45; 248/237

[56] References Cited

U.S. PATENT DOCUMENTS

| | | | |
|---|---|---|---|
| 298,463 | 5/1884 | Guedle | 182/45 |
| 590,872 | 9/1897 | Allen | 182/45 |
| 799,487 | 9/1905 | Neice | 182/45 |
| 1,159,372 | 11/1915 | Goff | 248/237 |
| 1,423,726 | 7/1922 | Mohr | 182/45 |
| 2,320,538 | 6/1943 | Vogt . | |
| 3,866,715 | 2/1975 | Foulk | 182/45 |
| 4,342,374 | 8/1982 | Montana | 182/45 |
| 4,450,935 | 5/1984 | Gustavus | 182/45 |
| 4,760,982 | 1/1988 | Cooke | 248/99 |

FOREIGN PATENT DOCUMENTS

| | | | |
|---|---|---|---|
| 2131475 | 6/1984 | United Kingdom | 182/45 |

*Primary Examiner*—Reinaldo P. Machado
*Attorney, Agent, or Firm*—Henderson & Sturm

[57] ABSTRACT

An adjustable roof support apparatus (10) for pitched roofs (100) including a horizontal platform member (14) and a vertical panel member (20) operatively secured together by fastening members (30) in a variety of angular dispositions so that the horizontal platform member (14) will be oriented parallel to the ground regardless of the angle of pitch of the pitched roof (100).

1 Claim, 1 Drawing Sheet

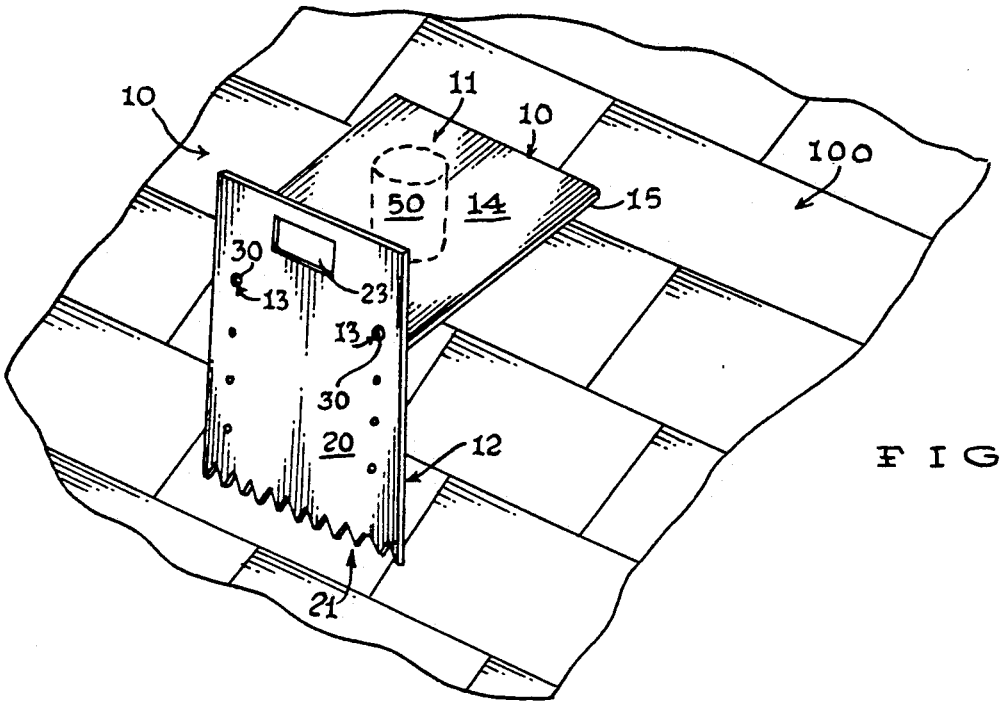
FIG. 1.
FIG. 2.
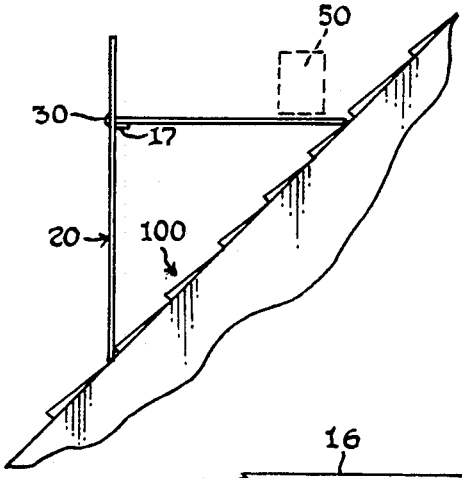
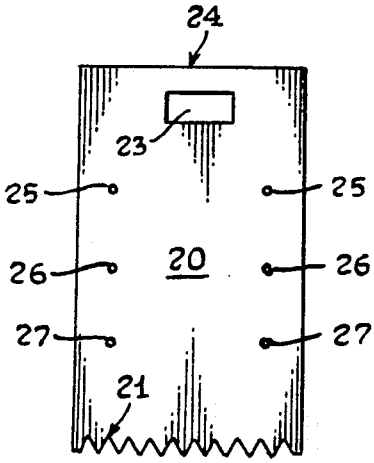
FIG. 3.
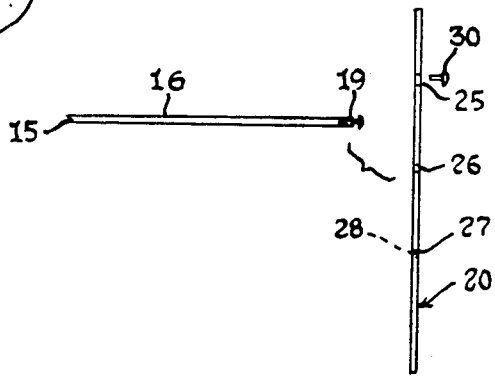
FIG. 4.

WORK PLATFORM APPARATUS FOR ROOFS

TECHNICAL FIELD

The present invention relates in general to the field of adjustable platform support surfaces, and in particular to an adjustable platform that is specifically designed to support articles on a pitched roof.

BACKGROUND ART

As can be seen by reference to the following U.S. Pat. Nos. 4,342,374; 3,866,715; 4,450,935; and 2,320,538; the prior art is replete with myriad and diverse adjustable roof platform support apparatus.

While all of the aforementioned prior art constructions are more than adequate for the basic purpose and function for which they have been specifically designed, these patented apparatus are uniformly deficient with respect to the simple fact that they are overengineered for the relatively simple task that they are expected to perform.

In fact virtually all of the patented constructions comprise multiple parts and components that are interconnected in a variety of ways; wherein, the mechanical failure of any portion of the apparatus will render the entire device inoperable.

In addition, the prior art constructions have evidently overlooked and/or ignored the age old maxim of using a simple tool for a simple task, and as a result undue complexity has crept into a field where this maxim has been honored more in the breach than in the observance.

DISCLOSURE OF THE INVENTION

Briefly stated, the work platform apparatus for roofs which forms the basis of the present invention comprises a horizontal support unit; a vertical support unit; and adjustment means for varying the angular disposition of the horizontal support unit relative to the vertical support unit.

The horizontal support unit comprises a generally elongated rectangular platform member having a tapered edge on one end and a relatively straight edge on the other end; wherein the straight end is provided with a pair of recesses for receiving fastening elements.

The vertical support unit comprises a generally elongated rectangular panel member having a toothed gripping surface provided on one end and a handle element formed proximate to but spaced from the other end; wherein the intermediate portion of the panel member is provided with a plurality of spaced and opposed apertures in vertically aligned pairs; and wherein the apertures are dimensioned for receiving the fastening elements for securing the horizontal support unit to the vertical support unit in a variety of angular orientations relative to one another.

The adjustment means mentioned supra comprises the combined cooperation of the fastening elements relative to the recesses and apertures in the horizontal and vertical support units respectively.

BRIEF DESCRIPTION OF THE DRAWINGS

These and other attributes of the invention will become more clear upon a thorough study of the following description of the best mode for carrying out the invention, particularly when reviewed in conjunction with the drawings, wherein:

FIG. 1 is a perspective view of the apparatus installed on a roof;

FIG. 2 is a side plan view of the apparatus on a roof;

FIG. 3 is an isolated front plan view of the vertical support unit; and,

FIG. 4 is an exploded perspective view of the apparatus as viewed from the side.

BEST MODE FOR CARRYING OUT THE INVENTION

As can be seen by reference to the drawings, and in particular to FIG. 1, the adjustable support apparatus for roofs that forms the basis of the present invention is designated generally by the reference numeral (10).

The apparatus (10) comprises in general: a horizontal support unit (11) a vertical support unit (12) and fastening means (13). These units and means will now be described in seriatim fashion.

As can best be seen by reference to FIGS. 1, 2 and 4 the horizontal support unit (11) comprises a generally flat elongated rectangular platform member (14) provided with a tapered edge (15) on one end (16) and a generally straight edge (17) on the other end (18) wherein the generally straight edge (17) is provided with a pair of spaced recesses (19) whose purpose and function will be described shortly.

Turning now to FIGS. 1 and 4 it can be seen that the vertical support unit (12) comprises a generally flat elongated rectangular panel member (20) having a toothed surface (21) provided on its lower end (22) and a handle opening (23) disposed proximate to, but spaced from its upper end (24). In addition the intermediate portion of the panel member (20) is provided with a plurality of spaced, vertically aligned aperture pairs (25)(25)(26)(26) etc.

Returning once more to FIGS. 1, 2 and 4, it can be seen that the fastening means (13) comprise fastening members (30) which are dimensioned to be releasably received in the recesses (19) in the straight edged end (18) of the horizontal support unit (11) as well as being received through a selected pair among the pairs (25)(25)(26)(26) of apertures in the vertical support unit (12) to operatively connect the vertical support unit (12) to the horizontal support unit (11) in a variety of angular dispositions relative to roofs (100) having different pitches such as 4:12 or 8:12; so that the horizontal support unit will be disposed parallel to the ground.

It should further be appreciated at this juncture that the toothed surface (21) on the vertical support unit (12) provides a frictional gripping surface which will tend to maintain the panel member (20) in a vertical orientation and the tapered edge (15) on the support platform (14) will likewise create a larger contact bearing surface on the pitched roof (100) wherein the weight of diverse supported articles (50) on the horizontal platform (14) of the apparatus (10) will increase the frictional engagement between the apparatus (10) and the roof (100).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claim.

I claim:

1. An adjustable support apparatus for pitched roofs having varying pitch angles wherein the apparatus consists of:

a horizontal support unit including a generally elongated flat rectangular platform member having a pair of spaced recesses formed on one edge; and a tapered surface on the opposite edge;

a vertical support unit including a generally elongated flat rectangular panel member having a plurality of spaced and vertically aligned pairs of apertures; wherein the panel member has an upper end and a lower end; and, the lower end is provided with a toothed gripping surface; wherein the panel member is further provided with a handle opening formed proximate to but spaced from said upper end; and, fastening means dimensioned to be releasably received in said recesses and through a selected one of said plurality of pairs of apertures for operatively connecting the horizontal support unit to the vertical support unit at a 90° angle.

* * * * *